United States Patent [19]

Canning

[11] 3,959,715

[45] May 25, 1976

[54] AUTOMATIC CONTROLLER FOR ELECTROSTATIC PRECIPITATOR

[75] Inventor: Bernard Canning, Birmingham, England

[73] Assignee: Dresser Industries, Inc., Dallas, Tex.

[22] Filed: Oct. 7, 1974

[21] Appl. No.: 512,575

Related U.S. Application Data

[63] Continuation-in-part of Ser. No. 415,592, Nov. 14, 1973, abandoned.

[30] Foreign Application Priority Data

Nov. 16, 1972 United Kingdom ..... 52912/72

[52] U.S. Cl. ..... 323/19; 55/105; 323/24

[51] Int. Cl.[2] ..... B03C 3/68

[58] Field of Search ..... 55/105, 139; 323/16, 323/19, 22 SC, 24, 45

[56] References Cited

UNITED STATES PATENTS

| | | | |
|---|---|---|---|
| 3,018,431 | 1/1962 | Goldstein | 323/45 |
| 3,379,960 | 4/1968 | May | 323/45 |
| 3,491,283 | 1/1970 | Johnston | 323/24 X |
| 3,529,404 | 9/1970 | Quissek | 55/105 |
| 3,562,625 | 2/1971 | Broek | 323/24 X |
| 3,577,708 | 5/1971 | Drenning et al. | 55/105 |
| 3,643,405 | 2/1972 | Vukasovic et al. | 55/105 |

*Primary Examiner*—A. D. Pellinen
*Attorney, Agent, or Firm*—William E. Johnson, Jr.

[57] ABSTRACT

By using a hill climbing technique, the input energy to the electrostatic precipitator electrodes is automatically increased until the electrode potential decreases. In response to the electrode potential decrease, the input energy is decreased. The electrode potential is controlled by an automatic voltage controller including an electrode potential sense circuit. The controller includes a digital store for increasing the count of the store and means responsive to the count in the store provide an output signal related to the count and means responsive to the signal from the electrode potential sensing circuit which is indicative of a fall in the electrode potential is used to reduce the count in the store. The count in the store is converted into an analog voltage used to control the duty cycle of thyristers and thus the precipitator electrode potential.

4 Claims, 8 Drawing Figures

AUTOMATIC CONTROLLER FOR ELECTROSTATIC PRECIPITATOR

RELATED APPLICATION

This application is a continuation-in-part application of my U.S. patent application Ser. No. 415,592 filed Nov. 14, 1973, for "AUTOMATIC VOLTAGE CONTROLLER", now abandoned.

BACKGROUND OF THE INVENTION

This invention is concerned with an automatic voltage controller that is particularly useful for the continuous control of the potential of precipitation electrodes in an electrostatic precipitator.

It is known in the art, for example, in U.S. Pat. No. 3,577,708 to Drenning et al, to reduce the input energy to the electrodes of an electrostatic precipitator in the event of sparking. However, such prior art systems have the disadvantage that the electrode potential can vary in the absence of sparking. Until such current-responsive systems do spark, they are non-responsive to the decrease of potential of the electrodes, which is widely variable because of corona discharge.

It is therefore the primary object of the present invention to provide an automatic controller for the electrodes of an electrostatic precipitator which is responsive to variations in the potential of said electrodes.

It is also an object of the present invention to provide such a controller that is simple, is flexible in use, and can be easily interfaced with existing precipitator power supplies.

SUMMARY OF THE INVENTION

The objects of the invention are accomplished, generally, by an automatic controller for adjusting the electrode potential in an electrostatic precipitator, comprising a source of input energy connected to the electrodes of said electrostatic precipitator, means for raising the input energy supplied to said electrodes, means for monitoring the electrode potential of said electrostatic precipitator, and means responsive to a decrease in said electrode potential to lower said input energy supplied to said electrodes.

The present invention is also an electrostatic precipitator including an automatic voltage controller, and an electrode potential sense circuit, the controller including a digital store means for increasing the count of the store, means responsive to the count in the store for providing an output signal related to the count and means responsive to a signal from the sense circuit indicative of a fall in the electrode potential to reduce the count in the store.

Preferably the store count is increased and decreased in discrete steps, the decrease step being greater than the increase step.

The objects, features and advantages of the present invention will be more readily appreciated from a reading of the following detailed specification and drawing, in which.

Figure 2A:
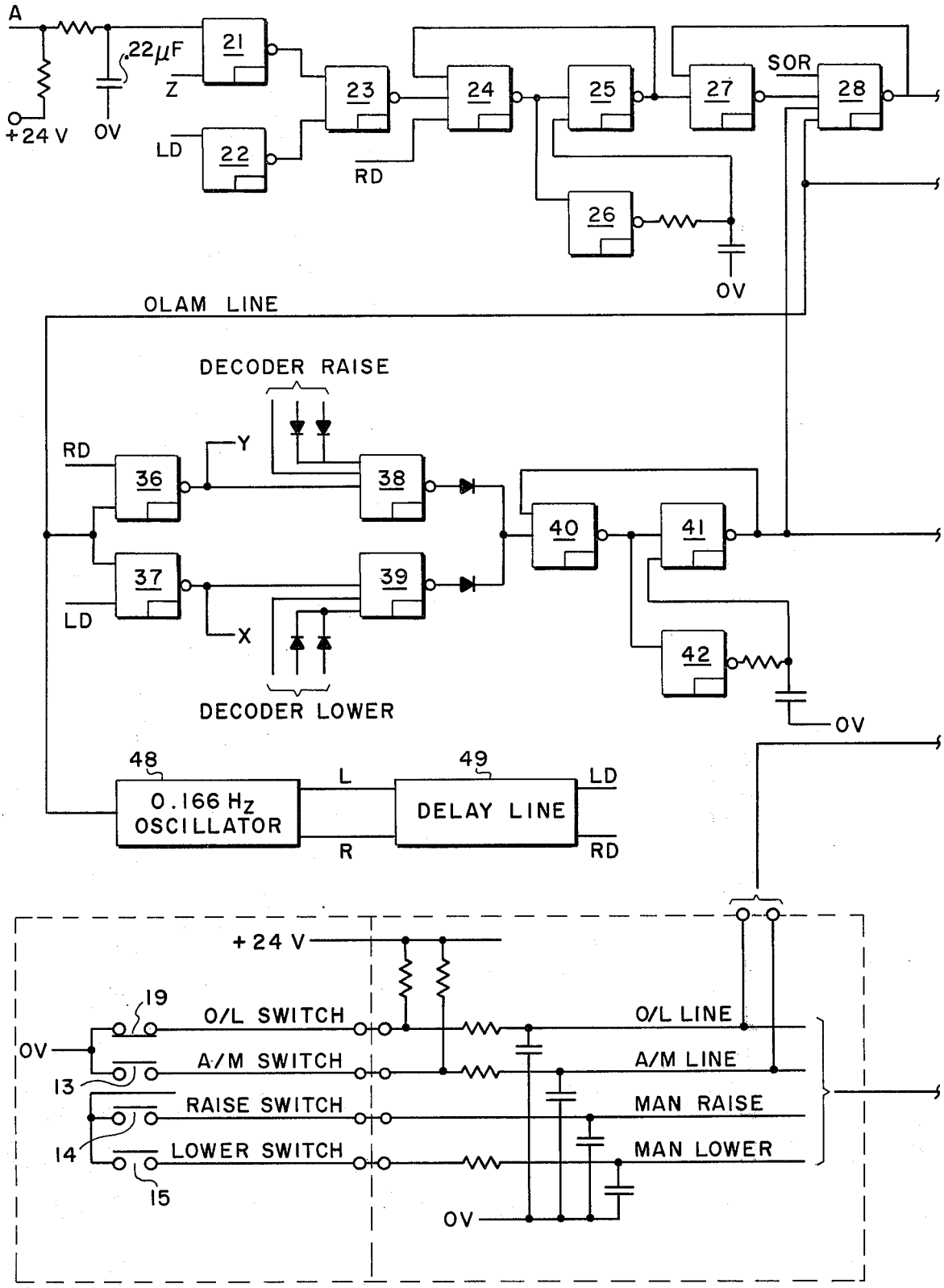
FIGS. 2A, 2B and 2C are together a block circuit diagram of an automatic voltage controller according to the present invention.
Figure 2B:
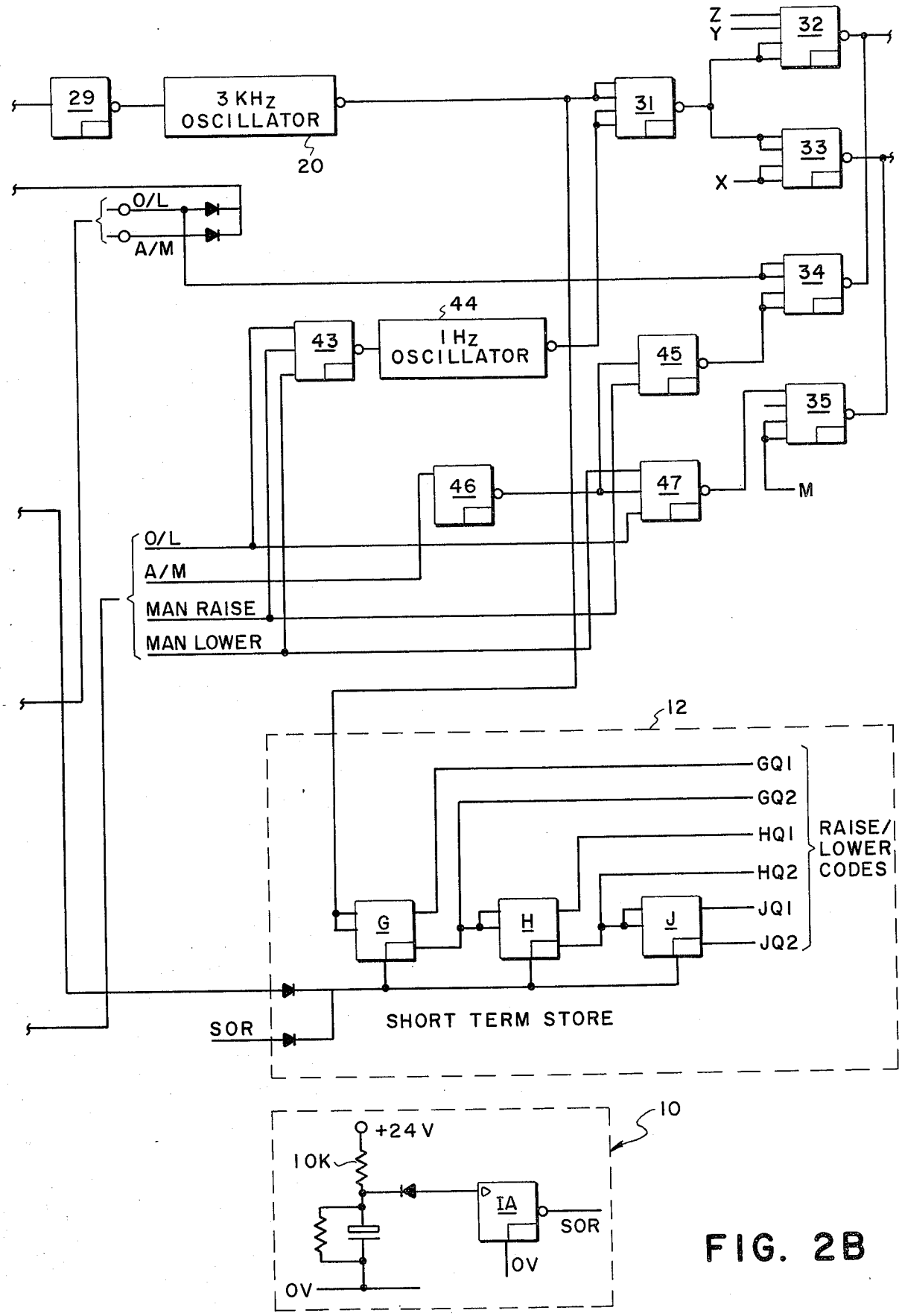
Figure 2C:
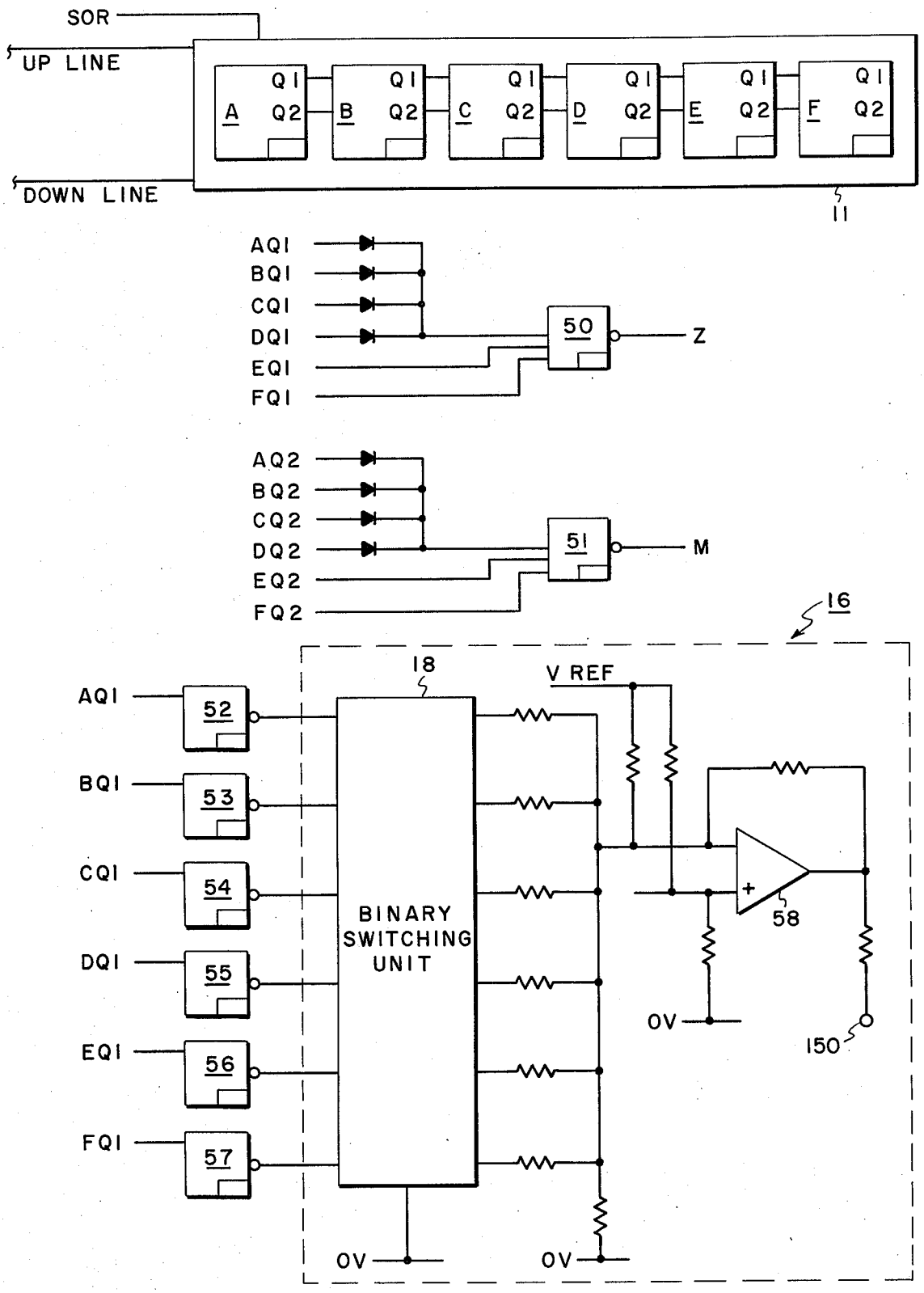
Figure 5:
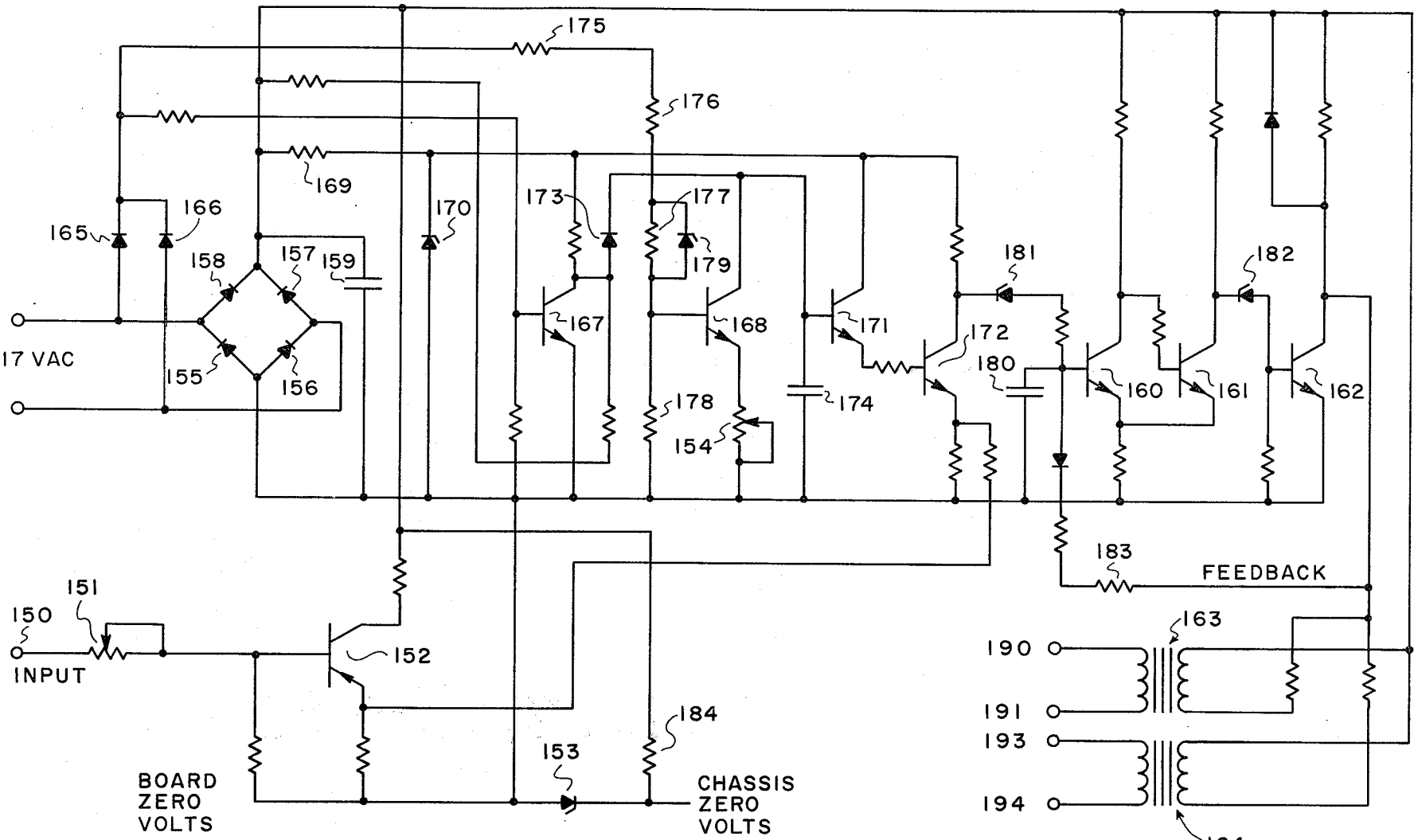
Figure 6:
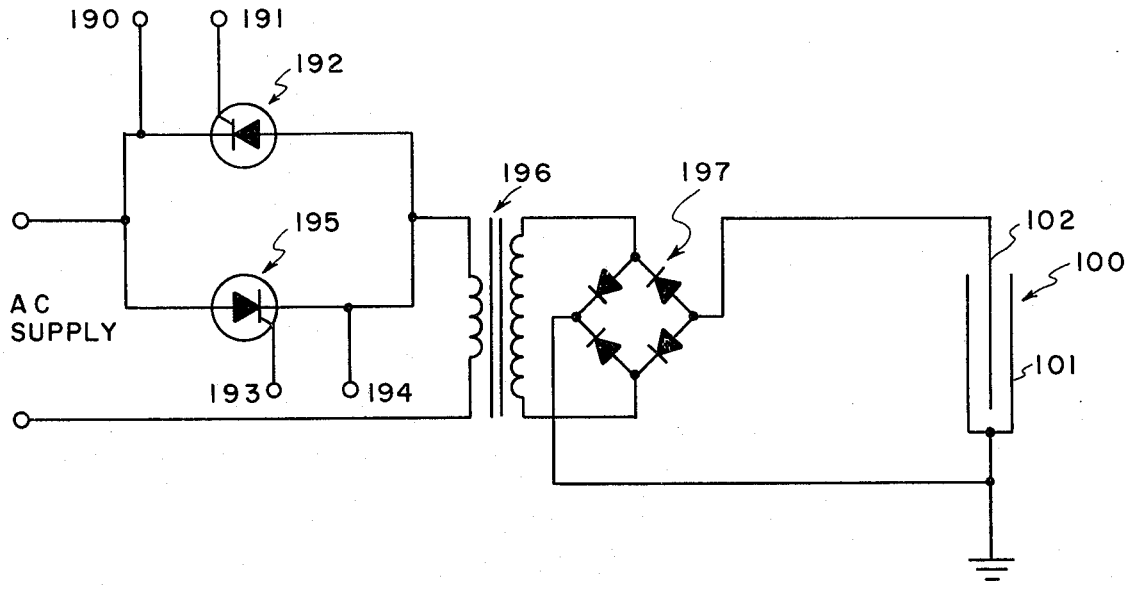

FIG. 5 is a schematic diagram of the driver circuit which utilizes the output of the digital-to-analog converter according to FIG. 2C to produce signals for effecting the input energy supplied to the electrostatic precipitator; and FIG. 6 is a schematic diagram which utilizes the driver signals produced in accordance with FIG. 5 to effect the input energy supplied to the electrostatic precipitator.

Figure 1:
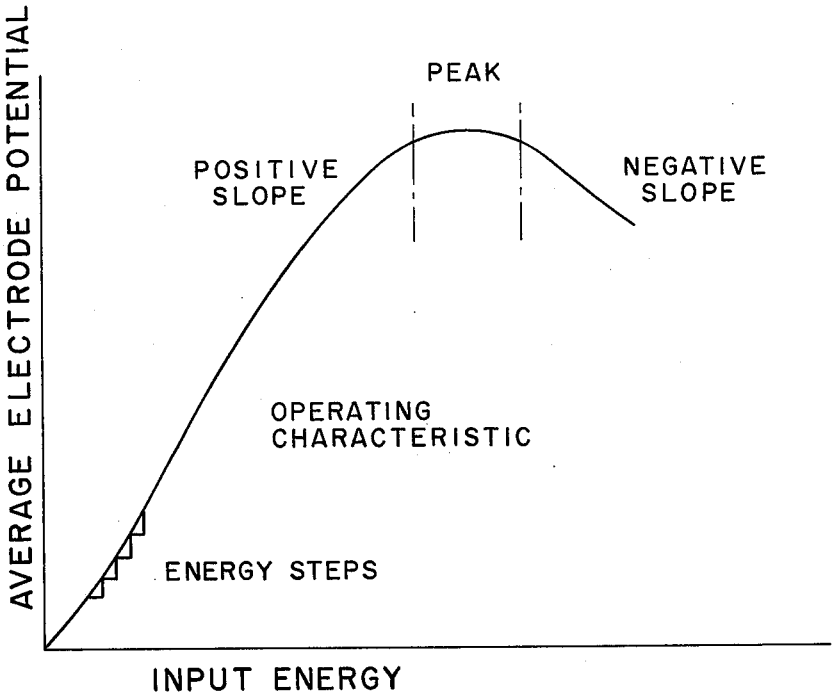
FIG. 1 is a diagram illustrating the principle of operation of the controller when in use with an electrostatic precipitator.

The embodiment of the automatic voltage controller according to the present invention that will now be described is designed for use with an electrostatic precipitator to maintain the maximum average precipitation electrode potential for a wide range of dust and gas conditions. This is achieved by a "hill climbing" technique which makes use of the fall in electrode potential occurring during heavy corona discharge. A typical electrode potential/input energy characteristic is illustrated in FIG. 1. It can be seen that the slope of the curve is positive to the left of the peak and negative to the right of it. Thus, this change of slope defines the region of maximum electrode potential and is utilized by the controller in accordance with the present invention to determine the operating electrode potential.

In operation, the controller increases the input energy to the electrode system in small steps, for example, every 5 or 6 seconds. After each energy step, a sense circuit, illustrated in greater detail in FIG. 4 hereinafter, determines whether the electrode potential has decreased. Provided the slope of the curve remains positive, no correcting action will be taken by the controller and the operating point climbs one step at a time to the top of the hill. When the slope becomes negative, however, the controller reduces the input energy by two steps, bringing the operating point back to the region of maximum electrode potential. Thus, any change in the operating characteristic can be readily followed by the controller. If no changes occur, the operating point will move about in a region of two energy steps about the point of maximum electrode potential.

The controller may also be operated in a manual mode which is useful for test and calibration. Overload limits are provided and can be used to set the maximum value of load current.

Before considering the other circuitry in detail, it should be noted that the controller is built up from comparatively few simple components, namely, bi-stable circuits, NOR gates, oscillators, an amplifier and a thyristor bridge together with associated diodes, resistors, capacitors and switches. The interconnection of the various circuit components will become apparent from the following description.

Referring now to FIGS. 2A, 2B and 2C, upon energization of the controller a switch-on-reset circuit 10 (FIG. 2B) provides an output pulse which is used to reset to zero all stores and memories in the controller. The circuit 10 performs no function other than this. The stores and memories reset by the output pulse from the circuit are a main memory 11 (FIG. 2C), a short term store 12 (FIG. 2B) comprising the bi-stable circuits G, H and J, and an auxiliary memory formed by the interconnected NOR gates 27 and 28 (FIG. 2A).

In the manual mode of operation, which will be considered first to simplify the description, an A/M switch 13 is opened. This applies a 1 signal to NOR gates 28, 36, 37 and 46 and a 0.166 Hz p.r.f. (pulse rate frequency) oscillator 48. The resulting states of the relevant circuit components are as follows: oscillators 20 (via inverter 29) and 48 are inhibited, the output of oscillator 20 being in a 0 state. X and Y inputs to NOR gates 33 and 32 are at 0, NOR gate 46 output is at 0, and the inputs to NOR gates 34 and 35 are at 1, thus closing these gates (output "0").

To cause the manual operation to raise the electrostatic precipitator input energy, the switch 14 is closed and a 1 is applied to NOR gates 43 and 45, allowing a 1 Hz oscillator 44 to run and opening gates 34 and 32, which, it should be noted, are interconnected to open and close as one gate. Gates 33 and 35 are similarly connected.

Pulses from the oscillator 44 are therefore routed into the main store 11 via a gate 31 and the "up" line. No pulses can be routed to the "down" line since gate 35 (and therefore 33) is closed. Pulses may be entered into the main store 11 to a value of 63, the main store 11 comprising six interconnected bi-stable circuits A-F. At this level, a 1 generated at the output of gate 50 is applied to gate 32, closing this gate and preventing any further pulses from being entered.

When the "lower" switch 15 is closed, a 1 is applied to gates 43 and 47, allowing the oscillator 44 to run and opening gates 33 and 35. Pulses are now removed from the main store 11 via the "down" line. No pulses can be routed to the "up" line since gate 34 (and therefore gate 32) is now closed. When the number of pulses stored reaches the zero level, a 1 generated at the output of a gate 51 is applied to the gate 35 closing this gate and preventing any further pulses being removed.

The information contained in the main store is in binary form and must be converted to an analog voltage. This conversion is carried out by a conversion circuit 16 such that the output voltage from an operational amplifier 58 is linearly related to the pulse count in the main store 11. As will be explained in more detail with respect to FIG. 5 hereinafter, a scaling factor is applied so that the minimum and maximum voltage levels required by the driver circuitry are provided to give no load and full load drive to thyristors which control the supply of current to a transformer which feeds a rectifier bridge which in turn supplies a potential to the precipitator.

As previously indicated, the manual mode is primarily used for test and calibration purposes.

Before going on to consider the automatic mode of operation, some circuit combinations and functions should be understood. NOR gates 21, 22 and 23 perform the AND function. A 1 is generated at the output of gate 23 only when 1's are applied to inputs of gates 21 and 22.

NOR gates 24, 25 and 26 form a "single shot" unit. A 1 applied to the inputs of gate 24 will produce a single 300 microsecond pulse at the output of gate 25. A similar function is performed by gates 40, 41 and 42 through in this case a 1 at the input of gate 40 produces a single 1 millisecond pulse at the output of gate 41.

NOR gates 27 and 28, as previously mentioned, form an auxiliary memory. A 1 applied to one input of gate 27 produces a 1 at the output of gate 28. This is fed back to the other input of gate 27 setting the memory. The memory may be reset to its original state by applying a 1 to either of the inputs of gate 28. The oscillator 20 produces a sharp falling edged pulse train at approximately 3 kHz p.r.f. The oscillator is inhibited by a 1 applied to its input. In this condition, the output is at 0. The oscillator is started by taking the input to 0. Oscillator 44 operates in a similar manner, its output also being at 0 when the oscillator is inhibited by a 1 at the input. Again, sharp falling edged pulses are produced but at approximately 1 Hz p.r.f.

Figure 3:
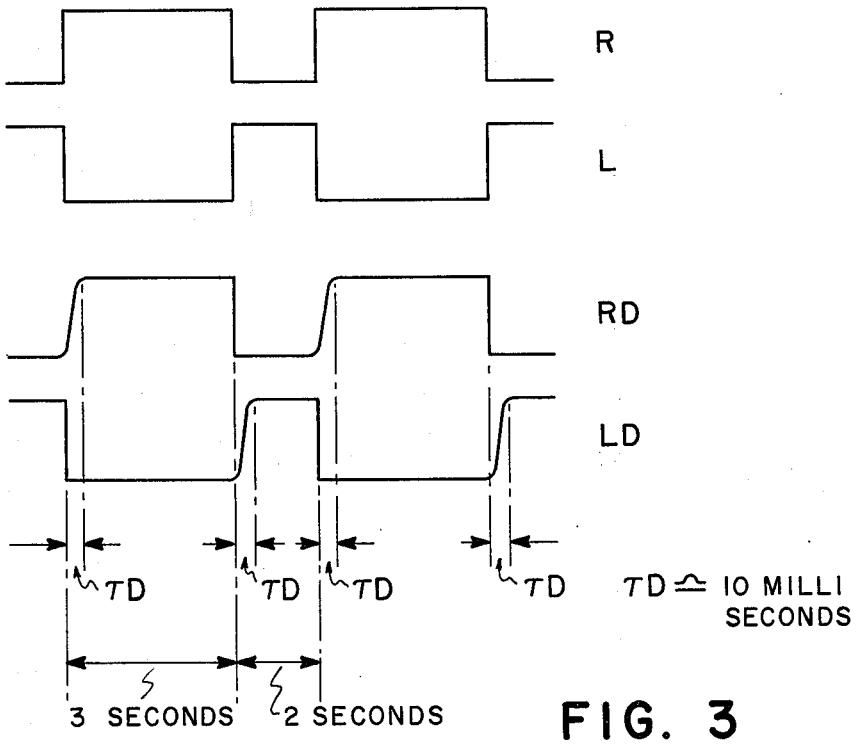
FIG. 3 is a waveform diagram illustrating the operation of a portion of the circuitry according to FIGS. 2A, 2B and 2C.

The oscillator 48 defines "lower" and "raise" periods by producing two trains of pulses L and R 180° out of phase (see FIG. 3). The mark-space times are independently variable but a common setting would be 3 and 2 seconds, respectively, with reference to the R train. The oscillator is inhibited by a 1 at the input. A delay unit 49 is used to delay the positive going edges of L and R. This produces a 10 millisecond "dead" zone between the finish of an R pulse and the start of an L pulse. The finish of an L pulse and the start of an R pulse are similarly separated.

Gate 38 forms a decoding function and is used in conjunction with the short term store 12 to fix the number of pulses put into the main store 11 during a "raise" period. The gate may be wired to set the number of pulses in the range 1 to 7. However, it is normally wired for one pulse.

Gate 39 forms the decode function for the "lower" period. It also may be wired for a range of one to seven pulses. Normally, the gate is wired for two pulses.

Flip-flops G, H and J form the "short term" store 12. It is used in conjunction with gates 38 and 39 to fix the number of pulses put in and taken out of the main store during the "raise" and "lower" periods.

As previously indicated, flip-flops A, B, C, D, E and F together with a number of gates not shown on the diagram form the main store 11. Gates 52 to 57 are used to drive the binary switch unit 18, providing an impedance match between flip-flops A, B, C, D, E and F and the unit 18.

The binary switch unit, ladder network and the operational amplifier 58 provide digital-to-analog conversion. The output voltage from the amplifier 58 is related to the number of pulses contained in the main store 11.

In the automatic mode, the A/M switch 13 is closed. The relevant circuit conditions will now be described with respect to the operation of the automatic mode.

Oscillator 48 will have a 0 applied to its input and will therefore be running. Gates 28, 36, 37 and 46 will have a 0 applied to their inputs, respectively.

During the "raise" interval, a 3 second pulse RD is applied to the input of gate 36 and also the input of the "single shot" (24, 25 and 26), respectively. The resulting 300 microsecond pulse output from the single shot sets the auxiliary memory (27 and 28) output to the 1 state. Inversion of the memory output takes place in gate 29 and the resulting 0 state applied to oscillator 20 causes it to run. Pulses from the oscillator 20 will be routed through gate 31 to gates 32 and 33. However, gate 33 will be closed since the X input is at 1 and pulses will only pass to the "up" line to raise the count of the main store 11. It should be noted that as RD is at 1 and LD is at 0, the X and Y outputs of gates 36 and 37 will be at 0 and 1, respectively. Pulses from the oscillator 20 are also routed to the "short term" store flipflops G, H and J, whereof the truth table is as follows:

TRUTH TABLE

| Pulse No. | G $Q_1$ $Q_2$ | H $Q_1$ $Q_2$ | J $Q_1$ $Q_2$ |
|---|---|---|---|
| 0 | 1 0 | 1 0 | 1 0 |
| 1 | 0 1 | 1 0 | 1 0 |
| 2 | 1 0 | 0 1 | 1 0 |
| 3 | 0 1 | 0 1 | 1 0 |
| 4 | 1 0 | 1 0 | 0 1 |
| 5 | 0 1 | 1 0 | 0 1 |
| 6 | 1 0 | 0 1 | 0 1 |
| 7 | 0 1 | 0 1 | 0 1 |

After one pulse has been entered into the "short term" store 12 and therefore also the main store 11, a 1 state is generated at the output of the "raise decode" gate 38. This is fed to the input of the "single shot" (40, 41 and 42). The resulting millisecond pulse does two things. It resets the auxiliary memory (27 and 28), thus stopping oscillator 20 and preventing any further pulses from being entered into either store. Secondly, it resets the temporary store to zero ready for the "lower" period. During the "lower" interval, a 2 second pulse LD is applied to the inputs of gates 37 and the AND gate 21, 22 and 23. The pulse on gate 37 causes the X output to be at the 0 state (the Y output will now be at 1 since RD is at 0). If no reduction of output is required, either because the controller is at 0 or the previous "raise" step resulted in an increase in precipitator electrode potential, the inputs to the AND gate will be at 0. Thus, there can be no output to fire the "single shot" (24, 25 and 26), the "memory" will not be set and the oscillator 20 cannot start. When a "lower" is required, a 1 generated by the electrode potential sense circuit (described hereinafter with respect to FIG. 4), and which is indicative of falling electrode potential, is applied to the input A of the AND gate 21, 22 and 23. With a 1 at the inputs of the AND gate (21, 22 and 23), a 1 is applied to the input of the single shot (24, 25 and 26), the memory is set by the resulting output pulse, and the oscillator 20 is started. Pulses from the oscillator are then routed via gates 31 and 33 to the "down" line (since gate 32 is now closed) reducing the number held in the main store. As before, pulses from the oscillator 20 are routed into the "short term" store 12. After two pulses have been entered into the "short term" store and therefore removed from the main store, a 1 is generated at the output of the "lower decode" gate 39. As before, this is fed into the input of the single shot (40, 41 and 42), resulting in the resetting of the memory, stopping oscillator 20 and resetting the "short term" store to zero ready for the "raise." The above sequence repeats as long as the automatic mode is selected.

It would be possible to lock the system up in the automatic mode if steps were not taken to prevent it. When 63 pulses are held in the main store, a 1 is generated at the output of decode gate 50 and is applied to gate 32 preventing further pulses entering the main store. There can therefore be no further increase in energy to the precipitator electrode system. The controller depends on detecting a fall in electrode potential to signal a "lower" being required. Thus, the system would be locked even if the electrode potential fell by a substantial amount. The system would become dependent on "noise" voltage to unlock the loop, not a satisfactory situation. To overcome this difficulty when decode gate 50 generates a 1, this is fed also to the input Z of the AND gate (21, 22 and 23) and as previously explained during the "lower" interval, the system is caused to reduce the store level by two pulses. In the next "raise" interval, the input energy to the electrode system can now be increased, making it possible to detect a lower signal if produced.

An overload limit is provided in both the automatic and manual modes, When an overload occurs, the O/L switch 19 opens, putting a 1 on the inputs of gates 28, 34, 36, 37, 43 and 47 and the oscillator 48. This effectively inhibits the automatic mode and overrides the raise switch in the manual mode. The pulse applied to gate 43 starts the oscillator 44 feeding pulses via gates 31 and 33 to the "down" line, reducing the number held in the main store. Pulses are prevented from reaching the "up" line by the 1 applied to gate 34. Pulses are removed from the store until the O/L switch closes, signifying that the overload has been removed. The circuit then reverts to its previous condition.

Figure 4:
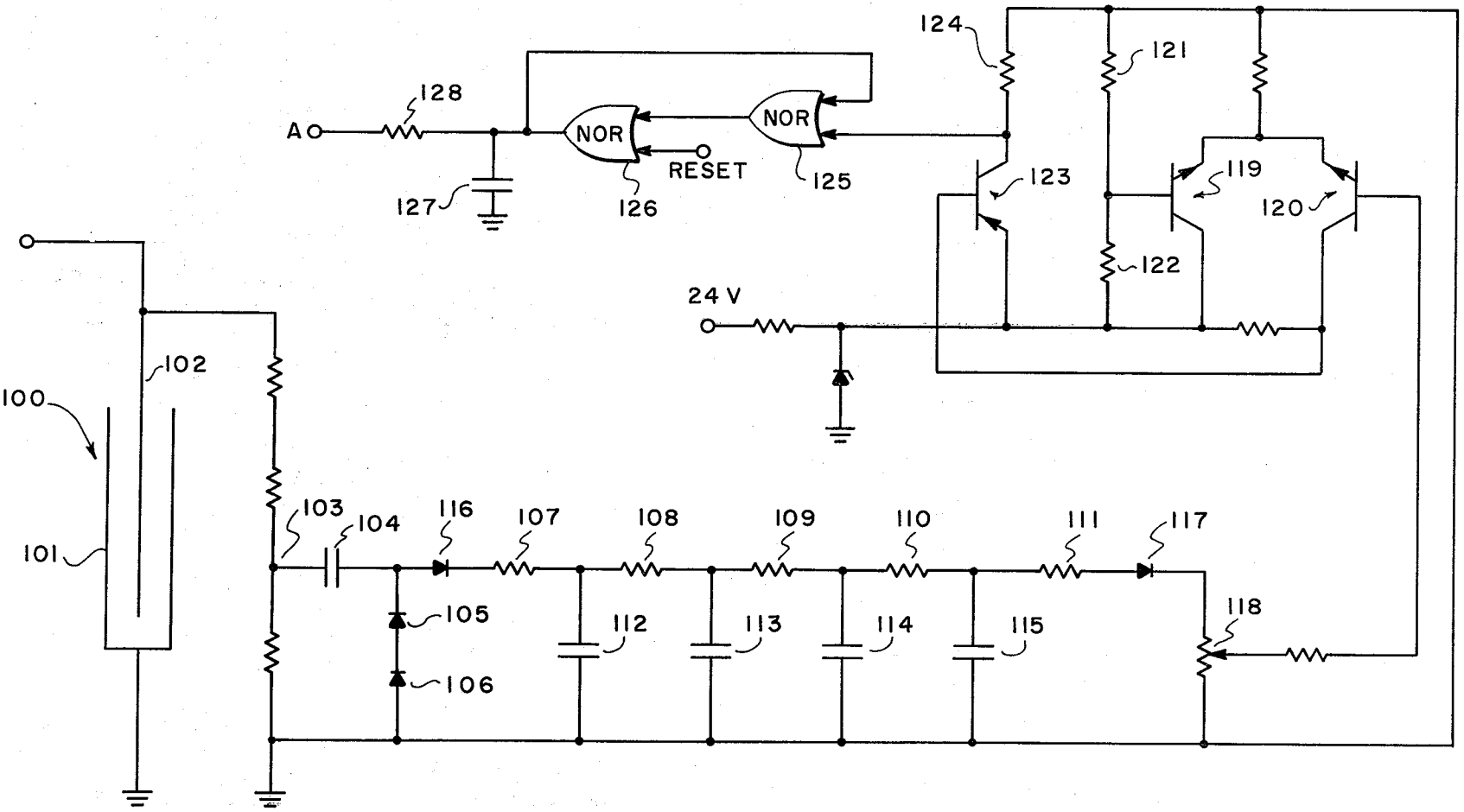
FIG. 4 is a schematic diagram of the sensing circuit according to the present invention which senses a drop in the electrode potential of the electrostatic precipitator.

Referring now to FIG. 4, there is schematically illustrated a circuit for sensing a decrease of the electrode potential in an electrostatic precipitator 100. In the particular precipitator 100 which is illustrated, the outside electrode 101 is grounded and the inner electrode 102 has a very high negative voltage impressed thereupon by the circuitry illustrated in FIG. 6 hereinafter. A voltage divider is connected between the electrode 102 and ground and a tap 103 in the voltage divider provides a means for sensing the fall in the electrode potential. A fall or decrease in the average kv level of the electrode is represented by the voltage appearing at the tap 103 which changes from a negative voltage to a less negative voltage, i.e., a positive increment. The incremental part of the signal from the tap 103 is obtained by differentiation by the capacitor 104. Negative increments are removed by the two diodes 105 and 106, and positive increments are passed to the resistance-capacitance integrating circuits formed by resistors 107, 108, 109, 110 and 111 and capacitors 112, 113, 114 and 115. The signal is passed by the diodes 116 and 117 to the potentiometer 118. A smoothed signal, proportional to the fall in the average kilovolt potential of the precipitator electrode, is developed across the potentiometer which forms the sensitivity adjustment, thus providing an adjustment of the scaling between the electrode fall and the output from the integrator. This signal from the wiper of the potentiometer is connected to the input of the "long-tailed-pair" differential comparator formed by the transistors 119 and 120. The reference voltage for the comparator is produced by the resistors 121 and 122, dividing the supply voltage to produce about 2.2 volts relative to zero volts at the base of the reference transistor 119. When the input from the potentiometer wiper is more positive then 2.2 volts, the input transistor 120 switches on and the reference transistor 119 switches off. When the input from the potentiometer is more negative than +2.2 volts, the input transistor 120 switches off and the reference transistor switches on. When a fall in average kv potential is experienced, the input from the potentiometer becomes more positive than 2.2 volts and the input transistor switches on, drawing current from the base of transistor 123. Transistor 123 consequently turns on and develops 18 volts across the load resistor 124. This voltage is connected to one of the inputs of NOR gate 125 and sets the memory producing a logic 1 at the output of NOR gate 126. The output is delayed by the capacitor 127 and is passed to the output point A by resistor 128. The memory can be reset by the reset input to NOR gate 126 as required. Thus, it should be appreciated that as a drop in the potential of electrode 102 of the electrostatic precipitator 100 occurs, a 1 is generated at the output point A. As was seen with respect to FIG. 2A, the 1 generated at point A causes the AND gate (21, 22 and 23) to be functional during the "lower" portion of the automatic mode.

Referring now to FIG. 5, the input terminal 150, which is also connected to the output of the operational amplifier 58 in FIG. 2C, is connected through a "set max" potentiometer 151 to the base of transistor 152. The base and emitter of transistor 152 are connected through resistors, respectively, to the "board zero volts." It should be appreciated that the zero volts line on this circuitry is not at chassis zero volts and that this circuitry has a separate 17 volt AC supply from the power pack. Zener diode 153 links the board zero volts with the chassis zero volts and holds it 3.3 to 4 volts above the chassis zero. This is to allow calibration of the output voltage from the digital/analog converter so that the zero to 63 counts represent the full output of the rectifier bridge of FIG. 6. This calibration is achieved by setting the "set min" potentiometer 154 described hereinafter so that the zero count voltage is adjusted to the minimum firing angle of the thyristors required by the precipitator. The upper limit is set by the "set max" potentiometer 151 which is adjusted to give the maximum firing angle of the thyristors required by the precipitator.

Supplies to the components are given by two power supplies. A full wave bridge rectifier supply comprised of rectifiers 155, 156, 157 and 158 of 24 volts smoothed by capacitor 159 is used to feed the Schmidt trigger oscillator transistors 160 and 161, the power amplifier transistor 162, the input transistor 152 and the trigger transformers 163 and 164.

An unsmoothed DC full wave rectifier supply is provided by the diodes 155, 156, 165 and 166. The unsmoothed supply is used as a reference for the base of transistor 167 and for a pulse shaping circuit with transistor 168. A 12 volt smoothed power supply is derived from the 24 volt supply using the resistance 169 and zener diode 170 to feed the respective collectors of transistors 167, 168, 171 and 172.

Transistor 167, since it has an unsmoothed waveform applied to its base, is turned off until this voltage exceeds 0.7 volts and it then conducts. During the time it is off, the voltage on its collector is limited to 6.8 volts by zener diode 173 and this voltage is used to charge capacitor 174. As soon as transistor 167 is turned on, the charging of capacitor 174 stops and diode 173 prevents discharge of the capacitor 174 through transistor 167. Thus, capacitor 174 receives a charging pulse at each half cycle zero of the supply voltage wave.

Transistor 168 acts as the discharge circuit for capacitor 174 and also as a wave shaping control because of the resistors 175, 176, 177 and 178. A zener diode 179 is connected across resistor 177 which is rather large compared to the resistors 175, 176 and 178. As the voltage of the unsmoothed DC starts to rise across the resistors 175, 176, 177 and 178, the current through resistor 177 causes the voltage drop across it to rise until it exceeds the switching voltage on the zener 179. This then shorts out the resistor 177 and the current flow increases. This also increases the voltage on the base of transistor 168 and increases the flow of current through such transistor.

As the half cycle voltage reduces, the zener 179 switches off and the current drain again slows through the transistor 168. This transistor is the discharge circuit for the capacitor 174.

Thus, the action so far described is to charge capacitor 174 at the zero of each half wave, then as the half cycle proceeds, to discharge it through transistor 168. The voltage discharge characteristic of capacitor 174 is to fall slowly at first, then to increase and then decrease again over the half cycle. This voltage is applied to the base of transistor 171 which acts as an emitter follower to give a higher impedance output so leaving unaffected the charge/discharge characteristic of capacitor 174. A falling ramp-type characteristic discharge of the capacitor 174 and thus the output of transistor 171 is established.

Transistor 172, having its base attached to the output of transistor 171, acts as a comparator between the falling ramp voltage on capacitor 174 and the level of the steady voltage from the digital-to-analog converter which is applied to the input terminal 150. This steady voltage is applied through the set-max potentiometer 151 to the base of transistor 152 whose output is then connected through a resistor to the emitter of transistor 172. This voltage determines the switching characteristic of transistor 172 in relation to its base voltage which is determined by the falling ramp voltage from capacitor 174. Thus, the ramp begins to fall from capacitor 174 and as it reaches the crossover point with respect to the voltage applied to the emitter of transistor 172, transistor 172 switches off, causing transistors 160 and 161 to operate. These transistors together from a Schmidt trigger pair operating as a 2 kHz oscillator due to the capacitor 180. Zener diodes 181 and 182 are used to allow full zero switching of transistors 160 and 161. The oscillator continues to oscillate until transistor 172 switches on at the supply wave zero. The output of the Schmidt trigger pair is applied to the base of the power amplifier transistor 162 and after amplification is coupled to the primary coils of the transformers 163 and 164, respectively. Feedback is provided through resistor 183 from the collector of the power amplifier transistor 162 to the base of transistor 160. It should be appreciated that the two transformers 163 and 164 are fired simultaneously and as will be shown hereinafter with respect to FIG. 6, the thyristor which is on the conducting half cycle will be triggered.

Resistor 184 is used as a current source for the zener diode 153 to the 24 volt supply to give the required voltage difference between the chassis and board zero volt references.

To summarize the operation of the circuitry illustrated with respect to FIG. 5, the input voltage applied to input terminal 150, being indicative of the count in the main store 11 of FIG. 2C, is compared with the declining ramp voltage generated by capacitor 174 and should the voltage at input terminal 150 be high, this will cause transistor 172 to switch off quicker and the Schmidt trigger oscillator to run longer. When the Schmidt trigger oscillator runs longer, a higher duty cycle is achieved by the thyristors of FIG. 6 to increase the energy supplied to the electrodes of the electrostatic precipitator.

Referring now to FIG. 6, the connections 190 and 191, being respectively connected to the secondary coil of transformer 163 in FIG. 5, are respectively connected to the cathode and gate of a thyristor 192, for example, a silicon controlled rectifier. In a similar manner, the connections 193 and 194, being connected to the secondary of the transformer 164 in FIG. 5, are respectively connected to the gate and cathode of thyristor 195, for example, a silicon controlled rectifier. The cathode of thyristor 192 is connected to the anode of thyristor 195 and together are connected to one side of a source of AC voltage. The anode of thyristor 192 is connected to the cathode of thyristor 195 which in turn are connected to one end of the primary coil of the high voltage transformer 196. The other side of the source of AC voltage is connected to the other side of the primary coil of transformer 196. The secondary coil of the high voltage transformer 196 is connected to the high voltage rectifier bridge 197. One side of the high voltage rectifier bridge 197 is connected to the grounded outer electrode 101 of the precipitator 100 and another output of the high voltage rectifier bridge is connected to the inner electrode 102. As previously mentioned, the duration of each positive pulse is controlled by the thyristor 192 and the negative pulses by thyristor 195. The thyristors do not conduct unless there are current pulses into the gates 191 and 193, respectively. These pulses cause the thyristors to conduct when the polarity of the alternating current supply is correct for the polarity of the particular thyristor. By controlling the duration of the pulses entering the gates by controlling the duration of the oscillations from the Schmidt trigger oscillator of FIG. 5 for each pulse of the alternating current supply, the current into the high voltage transformer and the high voltage rectifier and thus the energy supplied to the electrostatic precipitator is controlled.

Thus it should be appreciated that the preferred embodiment of the present invention has been described and illustrated herein. However, modifications to the preferred embodiment will be obvious to those skilled in the art from a reading of the foregoing detailed specification. For example, while the preferred embodiment contemplates the use of the circuitry for controlling electrostatic precipitators, it should be appreciated that the circuitry can also be used to control other devices having characteristic curves similar to that illustrated in FIG. 1.

The embodiments of the invention in which an exclusive property or privilege is claimed are defined as follows:

1. An automatic voltage controller for use in maintaining the maximum electrode potential in an electrostatic precipitator, the controller comprising:

a digital store;

means responsive to the count in the store for providing an output signal for controlling the electrode potential;

means for establishing alternating raise and lower periods in the operation of the controller;

a pulse source;

means for gating a specified number of pulses from said pulse source to the store during each raise period to increase the store count and thereby the electrode potential; and means responsive to a signal indicative of falling electrode potential for gating a specified number of pulses from said pulse source to the store during each lower period to reduce the store count and thereby the electrode potential.

2. A controller as claimed in claim 1, including an auxiliary store for counting said numbers of pulses during each of said raise and lower periods, and connected with said gating means to prevent the entry into said digital store of pulses in excess of the numbers specified in the respective periods.

3. A controller as claimed in claim 2, in which the specified number of pulses in a raise period is less than the specified number of pulses in a lower period.

4. A controller as claimed in claim 1, including means responsive to the maximum count in the digital store for operating said gating means, independently of said signal indicative of falling electrode potential, to reduce the digital store count.

* * * * *

UNITED STATES PATENT AND TRADEMARK OFFICE

CERTIFICATE OF CORRECTION

PATENT NO. : 3,959,715

DATED : May 25, 1976

INVENTOR(S) : Bernard Canning

It is certified that error appears in the above—identified patent and that said Letters Patent is hereby corrected as shown below:

On the Title page Item [73] Assignee:

delete "Dresser Industries, Inc., Dallas, Texas" and substitute therefore -- Lodge Cottrell Limited, Birmingham, England --.

Signed and Sealed this

First Day of June 1982

[SEAL]

*Attest:*

GERALD J. MOSSINGHOFF

*Attesting Officer*

*Commissioner of Patents and Trademarks*